US005931396A

United States Patent [19]

Firdaus

[11] Patent Number: 5,931,396

[45] Date of Patent: Aug. 3, 1999

[54] CHIPPER SHREDDER

[75] Inventor: Usman Firdaus, Strongsville, Ohio

[73] Assignee: MTD Products Inc., Cleveland, Ohio

[21] Appl. No.: 08/910,542

[22] Filed: Jul. 18, 1997

Related U.S. Application Data

[63] Continuation of application No. 08/382,483, Feb. 1, 1995, abandoned.

[51] Int. Cl.[6] ..... B02C 13/282

[52] U.S. Cl. ..... 241/73; 241/190

[58] Field of Search ..... 241/30, 92, 195, 241/190, 194, 243, 73, 88.4, 101.78, 188.1

[56] References Cited

U.S. PATENT DOCUMENTS

| | | | |
|---|---|---|---|
| 2,523,034 | 9/1950 | Lively | 241/188.1 |
| 3,412,770 | 11/1968 | Johnson | 241/101.78 X |
| 3,674,220 | 7/1972 | Tupper et al. . | |
| 3,688,479 | 9/1972 | Martinson et al. . | |
| 3,817,462 | 6/1974 | Hamlin . | |
| 3,850,364 | 11/1974 | Robbins . | |
| 3,857,521 | 12/1974 | Aasland et al. . | |
| 3,904,135 | 9/1975 | Bogie | 241/190 |
| 3,907,216 | 9/1975 | MacKissic et al. . | |
| 4,030,865 | 6/1977 | Kobayashi | 241/189.1 |
| 4,057,952 | 11/1977 | Brokaw | 241/101.78 X |
| 4,077,573 | 3/1978 | Kersey et al. . | |
| 4,117,983 | 10/1978 | Browning | 241/190 X |
| 4,214,713 | 7/1980 | Wright . | |
| 4,629,134 | 12/1986 | Pennekamp . | |
| 4,834,302 | 5/1989 | Baker | 241/92 |
| 5,018,672 | 5/1991 | Peck et al. | 241/73 |
| 5,042,730 | 8/1991 | Hundt | 241/92 X |
| 5,102,056 | 4/1992 | Ober | 241/190 X |
| 5,156,345 | 10/1992 | Baker . | |
| 5,199,653 | 4/1993 | Durrant et al. | 241/101.78 X |
| 5,240,189 | 8/1993 | Majkrzak et al. . | |
| 5,358,189 | 10/1994 | Vandermolen . | |
| 5,390,865 | 2/1995 | Vandermolen et al. | 241/92 X |
| 5,605,291 | 2/1997 | Doskocil . | |

FOREIGN PATENT DOCUMENTS

| | | | |
|---|---|---|---|
| 2161610 | 8/1996 | Canada . | |
| 2011275 | 7/1979 | United Kingdom | 241/189.1 |

*Primary Examiner*—Mark Rosenbaum
*Attorney, Agent, or Firm*—Emerson & Associates; Roger D. Emerson; Timothy D. Bennett

[57] ABSTRACT

An improved chipper shredder is disclosed having inwardly extending teeth affixed to the housing displaced from the discharge opening so as to provide additional shredding action.

5 Claims, 3 Drawing Sheets

CHIPPER SHREDDER

This is a file wrapper continuation of prior application Ser. No. 08/382,483 Feb. 1, 1995 entitled IMPROVED CHIPPER SHREDDER and now abandoned.

FIELD OF THE INVENTION

This invention relates to an improved chipper shredder and, more particularly, in the preferred embodiment, a chipper shredder having internal shredding teeth.

BACKGROUND OF THE INVENTION

Chipper shredders have been utilized in consumer and professional applications for years. The purpose of these chipper shredders is to translate the longitudinal length and/or physical volume of various types of vegetation into smaller pieces having lesser volume, typically by chipping or shredding the incoming vegetation. Examples include feeding a three inch diameter tree limb into a chipper section in order to reduce it to small wood chips and/or feeding many bushel baskets of leaves or small sticks into the device (normally via a separate shredding section in consumer devices) so as to shred the same into small particles. Typically, as the diameter of the branch is increased and as the volume of the sticks/leaves increase, the power requirements also increase dramatically. This can create problems in that the chipper shredder unit must be designed for worst case scenarios. This can be expensive.

OBJECTS AND SUMMARY OF THE INVENTION

It is the object of the present invention to reduce the horsepower requirements for chipper shredder units.

It is another object of the present invention to reduce the volume of residue produced by chipper shredders.

It is yet another object of the present invention to simplify the design of chipper shredders.

It is still another object of the invention to increase the efficiency of chipper shredders.

It is still another object of the present invention to lower the cost of chipper shredders.

Other objects and a more complete understanding of the invention may be had by referring to the following description and drawings in which:

BRIEF DESCRIPTION OF THE DRAWINGS

The structure, operation, and design of the presently disclosed preferred embodiment of the invention will become apparent on consideration of the following description taken in conjunction with the accompanying drawings wherein.

DETAILED DESCRIPTION OF THE INVENTION

Figure 1:
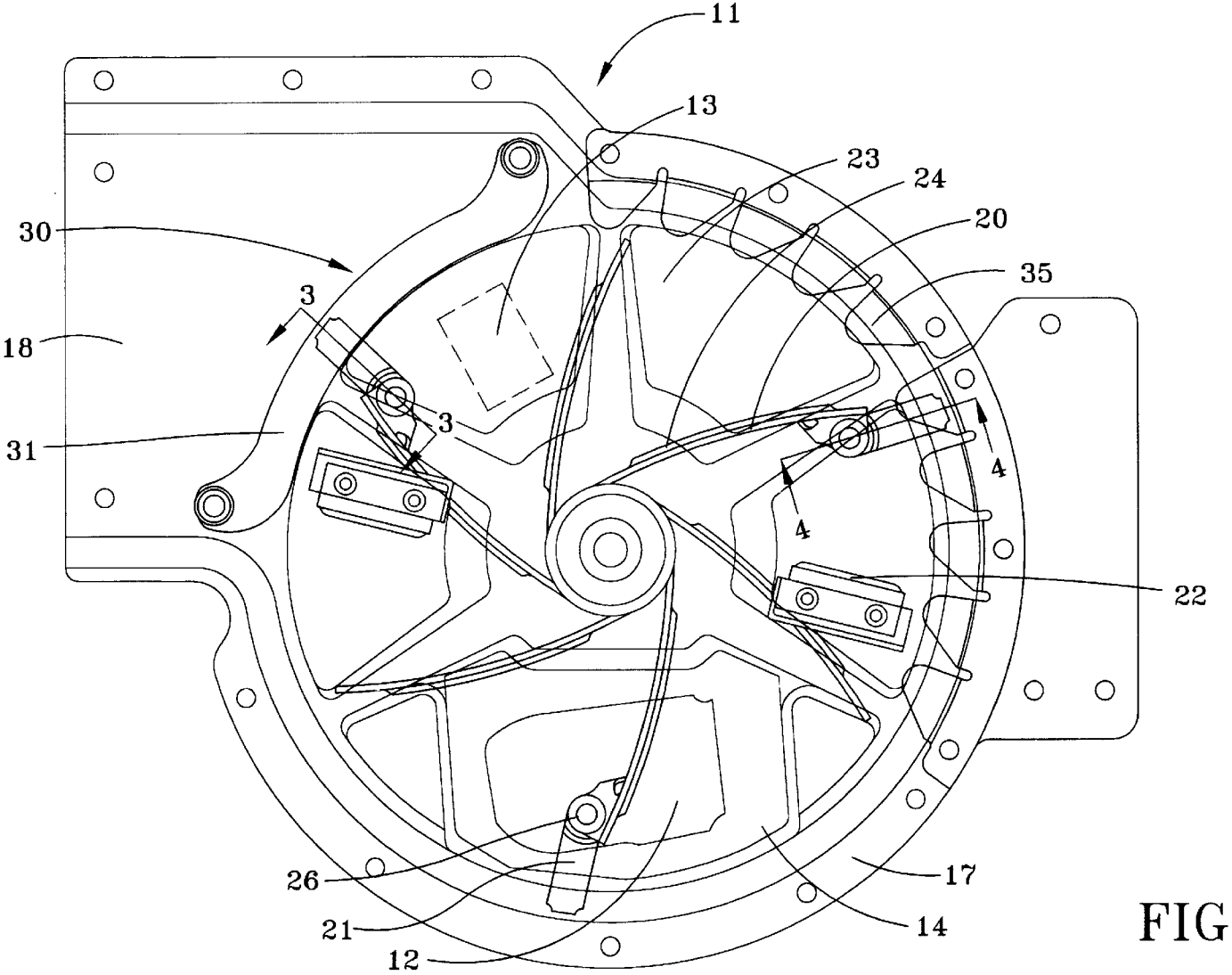
FIG. 1 is a lateral side view of a chipper shredder incorporating the present invention.
Figure 2:
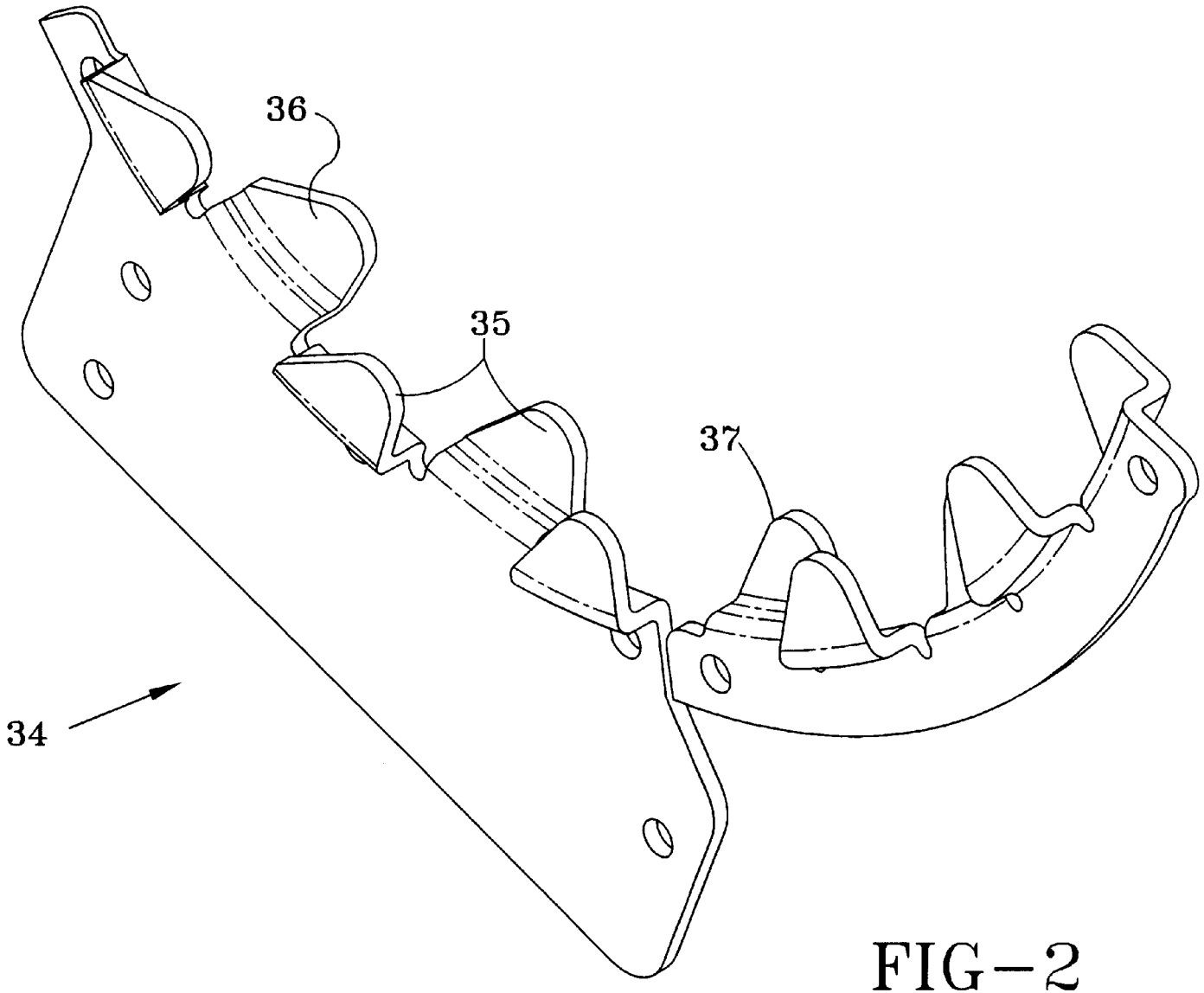
FIG. 2 is a perspective isolated view of the additional fixed teeth of the chipper shredder shown in FIG. 1.

This invention relates to an improved chipper shredder.

The invention will be described in a preferred embodiment of an improvement to the MTD Models 648 and 645 chipper shredders, the structure of which is incorporated by reference. These chipper shredders include a horizontal shaft engine (not shown), a housing 11, and an internal flail mechanism 20.

The engine provides the rotary power for the system. This is typically a five or eight horsepower horizontal shaft engine, directly bolted to the housing 11.

The housing 11 provides an enclosure physically containing the moving parts of the actual chipper shredder unit and the vegetation actively modified. Typically, this housing 11 is a stamped steel housing having a large lateral feed 12 for bulky objects, such as small branches and leaves, and a smaller lateral feed 13 for smaller more solid objects, such as branches up to perhaps three inches in diameter (since the feed 13 of the preferred embodiment is on the opposite side of the housing 11 from the feed 12, such feed 13 is shown in dotted lines).

The particular housing disclosed comprises two stamped parts 14, 15 bolted together at a central seam 16. This housing has an inner chamber some 16" in diameter and 4" in depth (overall diameter of connecting flanges 17 is about 19"). The larger lateral feed 12 is approximately 5¼" long and 3¼" wide. The smaller lateral feed 13 is approximately 2¼ long and 4" wide.

The larger lateral feed 12 is customarily a simple opening into the side of the later described inner flail 20. This allows direct access between the objects fed through such housing and the blades 21 of the inner flail 20. The lateral feed 12 is located approximately 180° opposite to the discharge opening 18. This feed 12 allows direct access to the blades 21 of the flail 20, promoting an aggressive shredding action, aided by the later described additional teeth 35.

The lateral feed 13 along the side of the inner flail 20 allows direct lateral access to the side chipper(s) 22 of the inner flail 20. While this promotes less aggressive action than the flail blades 21, the side chipper(s) 22 are designed for heavier duty cutting than the remainder of the inner flail 20 and thus can accommodate greater diameter branches and/or more load than the outer circumferential flail blades 21. Any chips that bypass the screen 30 are further broken down by the blades 21 of the flail 20 and the later described additional teeth 35. In that the chips are small, a high percentage are passed directly out of the discharge opening 18. In the preferred embodiment the smaller chipper opening 13 is located adjoining the discharge opening 18 and screen 30.

Figure 3:
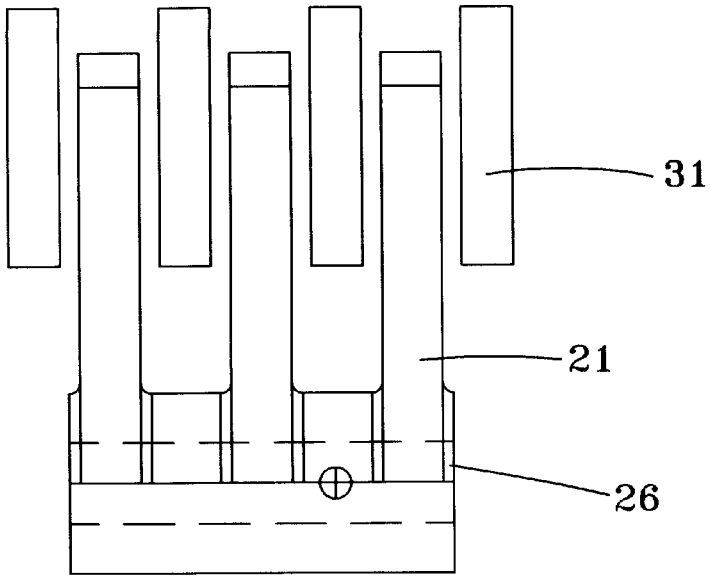
FIG. 3 is a cross sectional view of the chipper shredder of FIG. 1 showing the cooperation of the moving blades and fixed screen of the chipper shredder of FIG. 1 taken along lines 3—3; and, FIG. 4 is a cross sectional view like FIG. 3 showing the cooperation of the moving inner blades to the fixed teeth of the chipper shredder of FIG. 1 taken along lines 4—4.

Typically, the circumferential flail 20 has external blades or extensions 21 which are interconnected to a high mass central member 23 in order to pulverize materials which are fed through the chute or feeds 12, 13. Typically, these blades 21 are rotatively mounted to the central member 23 of the inner flail 20 such that only centripetal force maintains them extending outward of such flail 20 (they could be fixedly connected). These blades 21 also cooperate with a screen 30 which is separately affixed to the housing 11 adjacent to the discharge chute 18 in order to pulverize materials which are fed into the chipper shredder. Normally the blades 21 are interlineated with fixed sections or bars 31 of the screen 30 allowing an overlapping shredding action at this point (see FIG. 3). By this it is meant that the outer diameter of the blades 21 is greater than the inner diameter location of the screen 30, which difference in diameter produces an overlap that allows for the pulverizing action there between, and that the members are sequentially located to allow for an effective shredding action.

In the preferred embodiment the blades 21 comprise three outward extensions off of a central member 26, each tooth some 1" wide, ¼" thick and 2¼" long. The center lines of teeth are spaced by the extreme ends of the blades 21 and are cut away at the corners on a ¼" radius to improve efficiency and extend operational life. These blades 21 intervene with the four bars 31 of the cast screen 30, themselves some 10" long, 1⅓" wide spaced from each other by 1" (center to center). The inner edge of the screen 30 is spaced 7" from the center of the housing 11 so as to provide an overlap of about ⅞" with the blades 21. The leading edges of the reversible screen 30 are radiused with a 1" contour so as to facilitate the operation of the unit. The central member 23 has an overall diameter of 13½" with the blades 21 connected at a 5½" radius.

Due to the rotative connection between the blades 21 and the central member 23 of the flail 20, any major impediments will cause the blades 21 to rotate about their interconnection axis, and thus reduce the load on the engine and not cause any stalling or damaging torque increase on the engine 10.

Customarily, in the prior chipper shredder art, a significant amount of the shredding action occurs between the blades 21 and the screen 30. This concentrates most of the torque at this location. In addition due to the carry over of vegetation, the screen 30 must be very strong in order to absorb very high impact loadings. These are inefficient and damaging.

Figure 4:
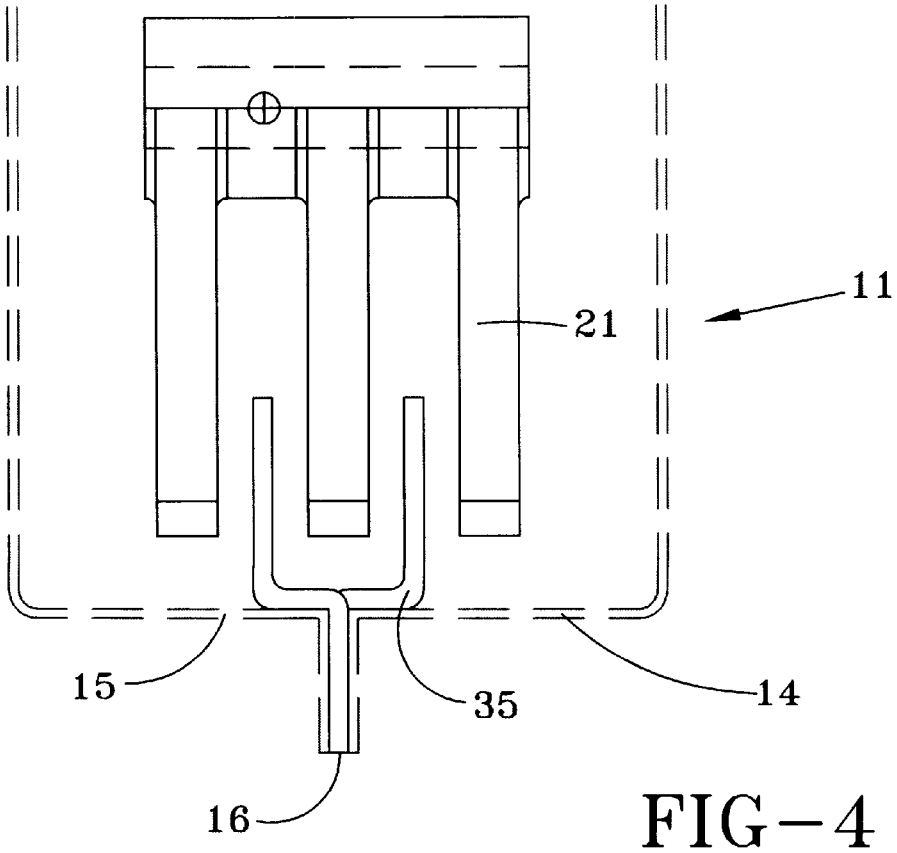

In the invention of the present application this is not true, due specifically to an outer blade 34 having a series of inwardly extending teeth 35 located somewhere within the shredding compartment. This would include being incorporated on the screen 30 at the discharge opening 18. By inwardly extending it is meant that the teeth 35 extend inwardly toward and substantially perpendicular to the axis of the inner flail 20 and central member 23 as shown in FIGS. 1 and 4.

These additional teeth 35 break up the vegetation carried about the circumference of the housing 11 by the blades 21, thus providing an additional location of shredding for the device. In this respect it is noted that in the prior art devices this vegetation would acquire a high kinetic energy due to its being carried at high speed in clumps by the blades 21 about the circumference of the device (wet leaves are particularly troublesome). In specific in the prior art devices, there is a tendency for the vegetation to accumulate in clumps along the inner circumferential surface of the housing 11. These clumps typically continue to travel about such circumference surrounding the blades 21 driven thereby. This accumulation dramatically increases the impact forces on the screen 30, as well as the steady state loading on the engine. This increase in loading requires an increase in engine horsepower as well as an increase in screen 30 strength. Not only did this kinetic energy reduce the effectiveness of the shredding action at the screen but, in certain instances, it could even physically deform the screen 30. The present invention avoids this build-up, thus increasing both effectiveness and longevity of the associated chipper shredder.

Preferably the location of the additional teeth 35 is displaced from the location of the screen 30 and between the shredding opening 12 and the discharge 18. The displaced location facilitates operation of the device by spreading the shredding action about the device circumference. The between location further facilitates shredding by allowing sequential operation. This also acts to equalize the torque loading on the device.

In the preferred embodiment disclosed, teeth 35 are set forth in multiple pairs interleaved with the blades 21 at a location between the input 12, 13 and the screen 30 and discharge opening 18.

In the invention of the present application, the additional fixed teeth 35 act to break up the accumulation, preferably at a location displaced from the screen 30. This reduces the loading of the device while increasing its efficiency.

The fixed teeth 35 connected to the housing 11 cooperate with the blades 21 of the inner flail 20 to pulverized vegetation which is fed into the chipper shredder. These teeth 35 thus also act to improve the efficiency of the chipper shredder by allowing for a more complete shredding of the vegetation prior to the discharge thereof through the output chute. Although the teeth are shown fixed to the housing in two rows, alternate methods of mounting including resiliently biased movable teeth and other shapes, numbers, and orientations could be utilized without departing from the invention.

In the preferred embodiment disclosed, the blades 21 are three in number for the inner flail 20 while the teeth 35 of the housing are arranged in two pairs of five tooth units. The teeth of the inner housing are interleaved with the blades of the flail such that the blades 21 and teeth 35 cooperate to pulverize any vegetation caught there between. Further to the above, the preferred teeth 35 have an inclined leading edge 36 which causes any vegetation which is circulated by the blades 21 to be moved inwardly, thus increasing the efficiency of the pulverizing process in addition to reducing parasitic loading. In addition due to the inward forces, the mass of any vegetation that is carried to and past the four section screen 30 in contact therewith is reduced, thus lowering the kinetic energy available parasitic power loss and for possible deformation of the screen 30. Further, the teeth 35 cooperate with the outward spirals 24 of the flail 20 by tossing material back and forth to further shred the input materials.

In the preferred embodiment disclosed the teeth 35, some ten in number, are located in two sections in aggregate extending some 19" about the outer circumference of the housing 11 with the base of the teeth at an 8⅖" radius from the center line of the housing 11. This substantially matches the inner radius of the housing 11. This provides for about ¾" over lap with the blades 21. Each individual tooth is ⅛" thick and extends slightly over 1 ⅛" into the housing in staggered formation with the two banks of teeth displaced ½" from the center line of the housing 11. The leading edge 36 of each tooth is angled, 46° shown, in order to increase the overall efficiency of the shredding action (as well as displacing any accumulated vegetation inward). The inner diameter of the teeth 35 is such in respect to the outer diameter of the flail blades 21 such that the two over lap, about ¾" in the preferred embodiment disclosed. Although not necessary to performance, the inward tips 37 of each tooth are radiused (0.38 shown) to increase the operational life of the teeth 35.

In the preferred embodiment, the multiplicity of the teeth 35 allows for a sequential pulverization of the vegetation as such vegetation is circulated throughout the inner circumference of the housing 11. This multiplicity of teeth further increases the efficiency of the pulverizing action of the improved chipper shredder. Further to the above, the fact that three flail blades 21 interleave with four bars 31 at the screen 30 and two sets of teeth 35 of the housing 11 increases the efficiency of the device through lateral displacement of forces. This also minimizes the residue that otherwise might continually travel about the device. In the preferred embodiment, the shredding action occurs in a shredding action region over 180° of the housing 11 (120° teeth 35; 60°+screen 30). This is preferred for allowing some momentum to build up on the blades 21 prior to driving engagement of material to the teeth 35. The preferred embodiment also allows for a recovery period between initial material contact (for example feed 12) and engagement of material to the teeth 35. Up to 360° of shredding action is possible through the inclusion of additional teeth 35.

Although the invention has been disclosed as preferred embodiment with a certain degree of particularity, it is to be understood that numerous changes can be made without deviating from the invention as hereinafter claimed.

What is claimed is:

1. A chipper shredder comprising:

a motor driven inner flail with blades;

a housing with an inner circumference of 360°, said housing having a feed and a discharge chute, said inner flail selectively rotatable within said housing; and, a shredding action region, said shredding action region extending continuously along between 120° and 240° of said inner circumference of said housing, said shredding action region including, A) an outer blade being fixedly attached to said housing, said outer blade having a series of teeth that extend inwardly, said teeth extending continuously along about between 90° and 150° of said inner circumference of said housing, said teeth of said outer blade being arranged in two pairs of five tooth units; and, B) a screen being fixedly attached to said housing, said screen extending continuously along between 45° and 75° of said inner circumference of said housing, said screen covering said discharge chute.

2. A chipper shredder comprising:

a motor driven inner flail with blades;

a housing with an inner circumference of 360°, said housing having a feed and a discharge chute, said inner flail selectively rotatable within said housing; and, a shredding action region, said shredding action region extending continuously along between 120° and 240° of said inner circumference of said housing, said shredding action region including, A) an outer blade being fixedly attached to said housing at a location displaced from said discharge chute, said outer blade having a series of teeth that extend inwardly toward the axis of said inner flail, said teeth extending continuously along about between 90° and 150° of said inner circumference of said housing, said teeth of said outer blade having a staggered formation; and, B) a screen being fixedly attached to said housing, said screen extending continuously along between 45° and 75° of said inner circumference of said housing, said screen covering said discharge chute.

3. A chipper shredder comprising:

a motor driven inner flail with blades;

a housing with an inner circumference of 360°, said housing having a feed and a discharge chute, said inner flail selectively rotatable within said housing; and, an outer blade having a series of teeth that extend inwardly, said outer blade being fixedly attached to said housing, said teeth extending continuously along between 90° and 150° of said inner circumference of said housing, said teeth of said outer blade being arranged in two pairs of five tooth units.

4. A chipper shredder comprising:

a motor driven inner flail with blades;

a housing with an inner circumference of 360°, said housing having a feed and a discharge chute, said inner flail selectively rotatable within said housing; and, an outer blade having a series of teeth that extend inwardly toward the axis of said inner flail, said outer blade being fixedly attached to said housing at a location displaced from said discharge chute, said teeth extending continuously along between 90° and 150° of said inner circumference of said housing, said teeth of said outer blade having a staggered formation.

5. A chipper shredder comprising:

a motor driven inner flail with blades;

a housing with an inner circumference of 360°, said housing having a feed and a discharge chute, said inner flail selectively rotatable within said housing;

an outer blade being fixedly attached to said housing, said outer blade having a series of teeth that extend inwardly, said teeth having a staggered formation and being arranged in two pairs of five tooth units, said teeth having a leading edge inclined to between 35° and 55°, said teeth having inward tips that are radiused, said teeth extending continuously along about 120° of said inner circumference of said housing, said teeth being interleaved with said blades of said motor driven inner flail; and, a screen being fixedly attached to said housing, said screen extending continuously along between 35° and 85° of said inner circumference of said housing immediately following said outer blade, said screen covering said discharge chute, said screen having an inner diameter less than the outer diameter of said blades of said motor driven inner flail.

* * * * *